United States Patent [19]

Voegelin

[11] 4,199,426

[45] Apr. 22, 1980

[54] DEVICE FOR FABRICATING THIN-WALLED METAL CYLINDERS

[75] Inventor: Heinrich Voegelin, Wiler b. Utzenstorf, Switzerland

[73] Assignee: Fritz Buser AG Maschinenfabrik, Switzerland

[21] Appl. No.: 969,573

[22] Filed: Dec. 14, 1978

[30] Foreign Application Priority Data

Dec. 29, 1977 [CH] Switzerland ..... 16215/77

[51] Int. Cl.[2] ..... C25D 7/04

[52] U.S. Cl. ..... 204/212; 204/224 R

[58] Field of Search ..... 204/199, 212, 224 R, 204/224 M

[56] References Cited

U.S. PATENT DOCUMENTS

| | | | |
|---|---|---|---|
| 1,733,404 | 10/1929 | Fahrenwald | 204/212 X |
| 2,689,215 | 9/1954 | Bart | 204/212 X |
| 3,193,450 | 7/1965 | Herbert et al. | 204/130 X |
| 3,743,590 | 7/1973 | Roll | 204/224 R X |

*Primary Examiner*—Arthur C. Prescott

*Attorney, Agent, or Firm*—Roylance, Abrams, Berdo & Farley

[57] ABSTRACT

In an apparatus having an expandable mandrel die cylinder for electro-plating thereon a thin-walled, hollow, metal cylinder with a closed or perforated wall, the hollow die cylinder is loosely fitted at its ends over support flanges. The clearance space between the cylinder and the flanges is sealed by a soft gasket and electrically bridged. During the plating, the die cylinder is radially expanded practically uniformly along its length by a pressurizing of the hollow space inside it. After completion of the plating, the pressure is released to contract the die cylinder and the metal cylinder which has been plated on the die cylinder is separated from it.

7 Claims, 2 Drawing Figures

DEVICE FOR FABRICATING THIN-WALLED METAL CYLINDERS

BACKGROUND OF THE INVENTION

The present invention relates to the fabrication of thin-walled metal cylinders by electroplating on an expanding mandrel die cylinder and then removing the plated material from the die.

It is known for the fabrication of thin-walled closed or perforated metal cylinders to use a roller-shaped die cylinder, or mandrel, having the dimensions of the hollow cylinder to be fabricated. For making a closed-wall hollow cylinder the entire outer mandrel surface is electrically conducting. For making a perforated hollow cylinder, especially cylindrical screens for the manufacture of screen printing forms, the outer mandrel surface has conductive and non-conductive areas corresponding to the perforations. Damage to the hollow cylinder must be avoided as much as possible. Since the screen cylinders, such as those for making screen printing masks, have relatively large dimensions, the removal of the electro-plated hollow cylinder is a relatively difficult operation. It is therefore known to resiliently expand the mandrel during the fabrication of the cylinder on it. While the removal of the plated hollow cylinder can be thereby aided, nevertheless special means must be provided at the non-expanded edges of the mandrel for removal of the cylinder, by which there is usually lost a portion of the length of the cylinder.

It is an object of the invention to provide a device of the type described above which is so designed that the electroplated hollow cylinder can without special means be removed undamaged from the surface of the mandrel after its fabrication and that practically the entire length of the mandrel can be utilized.

SUMMARY OF THE INVENTION

In accordance with the present invention, the ends of a mandrel cylinder are dimensioned for clearing a pair of end flanges, and can be loosely fitted over them. The clearance space between the mandrel cylinder and the support flanges is sealed by a soft gasket ring. The clearance space is bridged electrically by a slotted metal collar mounted on each supporting flange inside the hollow space in the mandrel and resiliently pressing against its inside surface. When the mandrel is expanded by a pressurizing of the hollow space with a fluid, the end portions are also permitted to expand, with the gasket in the clearance space maintaining the seal, so that the expansion of the mandrel is practically uniform along its length.

DESCRIPTION OF THE PREFERRED EMBODIMENT

Figure 1:
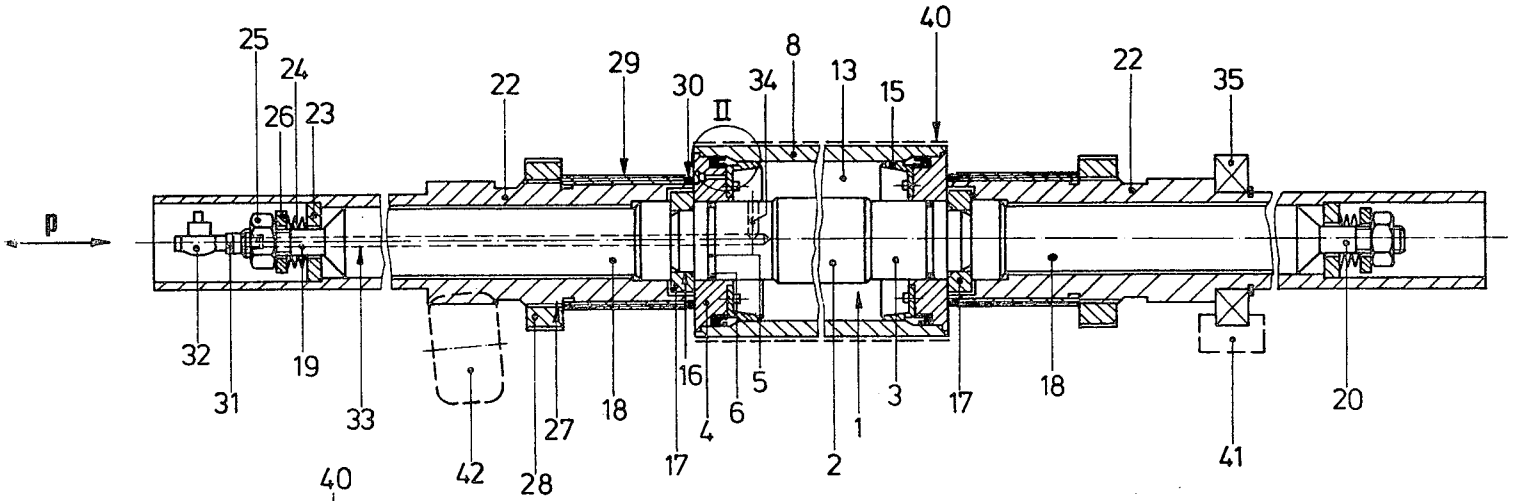
FIG. 1 is a longitudinal partial section of a device in accordance with a preferred embodiment of the present invention for fabricating thin-walled hollow cylinders by electro-plating.

The device shown in FIG. 1 has a central shaft 1 with two support sections 3 in the mid-portion, each of which has a support flange 4 pushed on it. The space between the support flanges 4 and the supporting sections 3 of the shaft 1 are sealed against pressure by a soft gasket, such as an O-ring gasket, lying in a groove 5 of the support sections 3.

Figure 2:
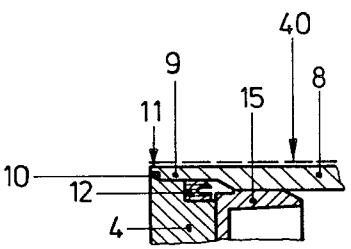
FIG. 2 is a section of a fragment of the device of FIG. 1 showing in more detail a rim region of the mandrel.

As can be seen especially from FIG. 2, a die-forming mandrel cylinder 8 is supported at its end portions 9 on the support flanges 4. Each support flange 4 has around its perimeter a rim 10, which is covered by a flange connecting to the end portion 9, so that the supporting flange 4 perimeter is completely covered by the mandrel 8. The mandrel 8 has sufficient clearance over the support flange 4 to permit it to be pushed onto it without force. The space between each support flange 4 and the end portion 9 of the mandrel 8 is sealed against pressure with a profiled gasket ring 12 having two sealing lips. There is thus formed a pressure-tight hollow space 13 by the support flanges 4 and the mandrel cylinder 8. For complete electrical contact between the support flanges 4 and the mandrel cylinder 8, there is fastened to each of the support flanges 4 inside of the hollow space a metal collar 15 with a slotted lip pressing resiliently against the inner wall of the mandrel cylinder.

To either side of the support flanges 4, there is on the central shaft a groove 16 in which there is inserted a two-part support ring 17 which serves as an axial stop for the support flanges 4. Adjoining each of the grooves 16 is a shaft extension 18 which is threaded at its other end to form a bolt 19, 20.

The gasket ring 12 can be arranged near the rim of the mandrel cylinder 8, here with the use of a support ring, so that practically the entire cylinder surface is under pressure and is expanded.

A support-and-protective casing 22 is pushed onto each of the shaft extensions 18 and centered. The support-and-protective casings 22 are pressed against the mid-portion 2 of the central shaft 1 by spring force. For this, there is arranged in the inside side of each support-and-protective casing 22 a stop ring 23, against which there rest the ends of compression springs 24 pushed over the threaded bolts 19, 20. The other ends of the compression springs 24 lie against a stop washer 26 held by a threaded nut 25. By means of the threaded nut 25, the spring force of the compression spring 24 can be adjusted. Each support-and-protective casing 22 has for this a threaded portion 27 on which there is threaded a ring nut 28. By means of the ring nut 28, a plastic sleeve 29 is pressed against the support flanges 4. A soft gasket ring 30 is situated between the support flanges 4 and the sleeve 29 for sealing.

At the end of the threaded bolt 19 there is screwed on a short piece of pipe 31 with a shut-off valve 32. A passageway 33 extends from the pipe 31 through the shaft extension 18 to the mid-portion 2 of the central shaft 1 and opens with a radially oriented port 34 into the hollow space 13.

The described device is rotatably mounted at the edge of an electroplating bath by a bearing cup 41 on the one side and between drive rollers 42 on the other, with the mandrel cylinder 8 being immersed in the bath.

Electrical current is supplied to the support-and-protection sleeve 22 by means not shown. The electrical connection between the support-and-protective casing 22 and the mandrel cylinder 8 is through the support flanges 4 and the metal collars 15.

Depending upon the designing of the outer surface of the mandrel cylinder 8, that is, whether it has a completely conducting or only partly conducting surface, there is plated on the mandrel cylinder 8 in operation a plating in the form of either a closed or a perforated hollow cylinder. Prior to the starting of the electro-plating, the hollow space 13 is pressurized with the aid of a pressure medium. Thereby, the mandrel cylinder 8 is radially expanded, and the hollow cylinder 40 is plated on the thus expanded cylinder 8. If the end portions of the mandrel cylinder 8 are designed with low wall strength, then the mandrel cylinder is expanded more evenly there, since the pressure p cannot be effective all the way to the outer rim of the mandrel cylinder 8. The profiled gasket ring 12 serves to seal the expanding space between the support flanges 4 and the mandrel cylinder 8, while the resilient metal collars 15 assure the electrical connection to the mandrel cylinder 8.

Since the hollow space 13 is completely sealed, it is possible to pressurize it to about 300 bars through the valve 32 and to then close the valve. The pressure acting on the mandrel cylinder 8 is thereby maintained during the course of the rotation of the device in the plating bath.

When the hollow cylinder 40 has been plated to the desired wall thickness, then the plating is interrupted and the pressure inside the mandrel cylinder 8 released, so that it once again takes on the diameter that it had prior to the pressurizing. As a result of the uniform expansion, the plated cylinder permits itself to be readily removed from the surface of the mandrel cylinder 8 without the aid of mechanical means. Due to the ability to release the hollow cylinder 40 easily and without mechanical means, the useful life of the surface of the mandrel cylinder 8 is significantly increased. At the same time, there results a precisely cylindrical shape for the released hollow cylinder 40.

There can also be used in place of the mandrel cylinder 8 some other expandable hollow cylinder which serves to stretch and hold a further hollow cylinder with an inner diameter within the expandable range of the holding cylinder. Various operations can be carried out on a hollow cylinder fastened in this manner. In particular, thin-walled mandrel cylinders with electrically conductive and nonconductive portions can be made. These can then be elsewhere similarly fastened and used for the electroplating of hollow cylinders, thus making unnecessary the transporting of heavy mandrel cylinders.

I claim:

1. Apparatus for the manufacture of a thin, hollow, closed-wall or perforated-wall metal cylinder by electro-plating a metal on a smooth dye cylinder having accordingly a completely or partly conducting surface and which rotates submerged in an electro-plating bath, said die cylinder being supported at its ends on support flanges and forming with these a pressure-tight hollow space which can be pressurized by a pressure medium, said die cylinder being expanded during the electroplating, where the improvement comprises:

said die cylinder being loosely fitted over said support flanges with a clearance space between said die cylinder and said support flanges, a resilient gasket being disposed in said clearance space to seal it, and means being provided within said hollow space within said die cylinder for bridging electrically said clearance space between said die cylinder and said support flanges.

2. The apparatus of claim 1, wherein said die cylinder has at its end portions in the region of said support flanges a lesser wall strength than at its mid-portion.

3. The apparatus of claims 1 or 2, wherein said support flanges are sealingly supported on a central shaft.

4. The apparatus of claim 3, wherein said support flanges push axially against a stop-ring lying in a groove on said central shaft.

5. The apparatus of claim 1, wherein the clearance space between said die cylinder and said support flanges is bridged electrically by means of a metal collar.

6. The apparatus of claim 3, wherein said central shaft includes shaft extensions extending beyond said support flanges and onto which there is pushed a support-and-protective casing which is pressed axially by spring force against said support flanges.

7. The apparatus of claim 1, wherein a hollow, second die cylinder is mounted on said first die cylinder for electro-plating on said second die cylinder.

* * * * *